US005200572A

United States Patent [19]

Bissonnette et al.

[11] Patent Number: 5,200,572

[45] Date of Patent: Apr. 6, 1993

[54] ELLIPITCAL ELASTOMERIC IMPULSE ENERGY STORAGE AND TRANSFER SYSTEM

[75] Inventors: Laurent C. Bissonnette, Narragansett; Scott D. Boyd, Portsmouth; Jeffrey R. Milburn, Providence, all of R.I.

[73] Assignee: The United States of America as represented by the Secretary of the Navy, Washington, D.C.

[21] Appl. No.: 910,044

[22] Filed: Jul. 8, 1992

[51] Int. Cl.[5] ..... B63G 8/28; F41F 3/10

[52] U.S. Cl. ..... 89/1.81; 114/238; 124/73

[58] Field of Search ..... 114/238, 316, 319, 318; 89/1.809, 1.81; 124/73, 71, 72; 42/1.14

[56] References Cited

U.S. PATENT DOCUMENTS 1,656,249 1/1928 Techel ..... 114/238
2,546,961 4/1951 Amero ..... 114/238
3,075,301 1/1963 Fiedler et al. ..... 89/1.81
3,516,380 6/1970 Johnston ..... 114/238
4,523,538 6/1985 Hollmann et al. ..... 114/238
4,848,210 7/1989 Bissonnette ..... 89/1.81

*Primary Examiner*—David H. Brown
*Attorney, Agent, or Firm*—Michael J. McGowan; Prithvi C. Lall; Michael F. Oglo

[57] ABSTRACT

An elastomeric impulse energy storage and transfer system comprising an accumulator body of elastomeric material, the body having an opening at a base portion thereof, the body having in elevation a frusto-ellipsoidal configuration, and the body taken along a sectional plane parallel with the base portion having an ellipsoidal configuration, the body being adapted to receive and discharge fluid through the opening, the body being expandable and contractible in response to receiving and discharging, respectively, the fluid, the body being adapted to retain the frusto-ellipsoidal and ellipsoidal configurations when in an expanded condition, and a submarine projectile launch system having the accumulator body as a component thereof.

6 Claims, 5 Drawing Sheets

ELLIPITCAL ELASTOMERIC IMPULSE ENERGY STORAGE AND TRANSFER SYSTEM

STATEMENT OF GOVERNMENT INTEREST

The invention described herein may be manufactured and used by or for the Government of the United States of America for governmental purposes without the payment of any royalties therefor.

BACKGROUND OF THE INVENTION (1) Field of the Invention

The invention relates to elastomeric impulse energy storage and transfer systems, particularly as used in low-noise projectile launching systems.

(2) Description of the Prior Art

It is known to rapidly convert potential energy of a working fluid to kinetic energy for a projectile launch by means of ram pump and turbine pump ejection systems. Both systems are mechanically complex and tend to radiate noise into the surrounding fluid medium.

A ram pump type of energy storage and conversion system converts the potential energy of compressed air stored in a flask to kinetic energy by means of a piston assembly. The system requires a massive piston apparatus to transfer sufficient kinetic energy to a working fluid to launch a projectile. The mechanical friction and the mass of the piston act to reduce system efficiency and to produce substantial radiated noise. The ram pump system includes numerous mechanical components, in addition to the piston assembly, which require frequent maintenance.

A turbine pump type energy storage and conversion system converts potential energy of compressed air stored in a flask to kinetic energy of a working fluid by the cooperative interaction of three major components: an air turbine, a speed reduction unit, and a rotary impeller pump. The turbine system further requires a complex high-speed air turbine drive inlet and a complex low cavitation impeller pump. The turbine system thus is costly. Because of the dynamic interaction of system components, the turbine system tends to be noisy. In addition, overall system efficiency is quite low because of mechanical losses.

In U.S. Pat. No. 4,848,210, issued Jul. 18, 1989 to Laurent C. Bissonnette, there is shown and described an impulse energy storage and transfer system having as a principal component thereof an elastomeric energy storage device. The elastomeric device is adapted to accept and store a working fluid. In accepting the working fluid, the elastomeric means, a bladder-type accumulator, becomes distended. Upon opening of the accumulator for egress of the working fluid, the stored energy is rapidly converted into kinetic energy for quietly ejecting a projectile, along with the stored fluid, from the system and into a surrounding medium. The accumulator used in the '210 system is substantially spherical.

While the '210 system has demonstrated marked improvement over the prior ram pump and turbine pump types of systems, there remain problem areas. As the spherical accumulator discharges the working fluid, typically a liquid, such as water, the collapsing accumulator reaches a point in its configuration transition in which the stored medium flows erratically from the accumulator and creates an audible noise. It is beneficial to have a smooth and even flow of working fluid from the accumulator and to eliminate any noises emanating therefrom.

SUMMARY OF THE INVENTION

An object of the present invention is to provide an elastomeric impulse energy storage and transfer device and system featuring an elastomeric accumulator having facility for discharging working fluid therefrom in a smooth and even manner and without audible noise.

A further object of the invention is to provide an elastomeric impulse energy storage and transfer accumulator provided with a configuration facilitating its improved performance relative to the substantially spherical accumulator of the prior art.

With the above and other objects in view, as will hereinafter appear, a feature of the present invention is the provision of an elastomeric impulse energy storage and transfer device comprising an accumulator body of elastomeric material, the body having an opening at a base portion thereof, the body having, in elevation, a frusto-ellipsoidal configuration, and the body, taken along a sectional plane parallel with the base portion, having an ellipsoidal configuration, the body being adapted to receive and discharge fluid through the opening, the body being expandable and contractible in response to receiving and discharging, respectively, the fluid, the body being adapted to retain the configuration when in the expanded condition.

In accordance with a further feature of the invention, there is provided an elastomeric impulse energy storage and transfer device wherein the elastomeric body, upon discharge of the fluid therefrom, is adapted to have side walls thereof converge toward one another in a substantially symmetrical manner.

In accordance with a still further feature of the invention, there is provided an elastomeric impulse energy storage and transfer system for launch of projectiles into a liquid medium, the system comprising a launch tube having a muzzle end and a breech end, the launch tube being adapted to house a projectile and slidably guide the projectile during a launch, a breech valve attached to the launch tube at the breech end, the breech valve being adapted to provide access to the interior of the launch tube from the breech end for loading the projectile; a muzzle valve attached to the launch tube at the muzzle end, the muzzle valve being adapted to permit egress of the projectile from the launch tube into the liquid medium, a cylindrical collar fixed to the launch tube between the muzzle end and the breech end, nearer to the breech end, so as to be disposed behind the projectile, the collar means having a longitudinal axis generally normal to a longitudinal axis of the launch tube, the cylindrical collar being adapted to provide access by a working fluid to the launch tube at a point behind the projectile, a control valve mounted on the collar for selectively placing the interior of the collar in communication with the interior of the launch tube, an elastomeric accumulator fixed to the collar at a planar base of the accumulator, the accumulator having in elevation a frusto-ellipsoidal configuration, and the accumulator having an ellipsoidal configuration along a sectional plane parallel with the accumulator base plane, the accumulator being adapted to store energy by elastic expansion of walls thereof, an exterior surface of the accumulator being exposed to the pressure of the liquid medium, and a pump having a suction side thereof in communication with the liquid medium and a discharge side thereof in communication with the accumulator via the collar, for selectively pumping the liquid into the accumulator to inflate and distend the accumulator, whereby upon opening of the muzzle valve to flood the launch tube and opening the control valve to place the accumulator in communication with the launch tube via the collar, the accumulator contracts, thereby forcing the liquid medium stored in the accumulator through the collar and out the muzzle end of the launch tube along with the projectile.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of the invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent.

In the drawings.

DESCRIPTION OF THE PREFERRED EMBODIMENT

Figure 7:
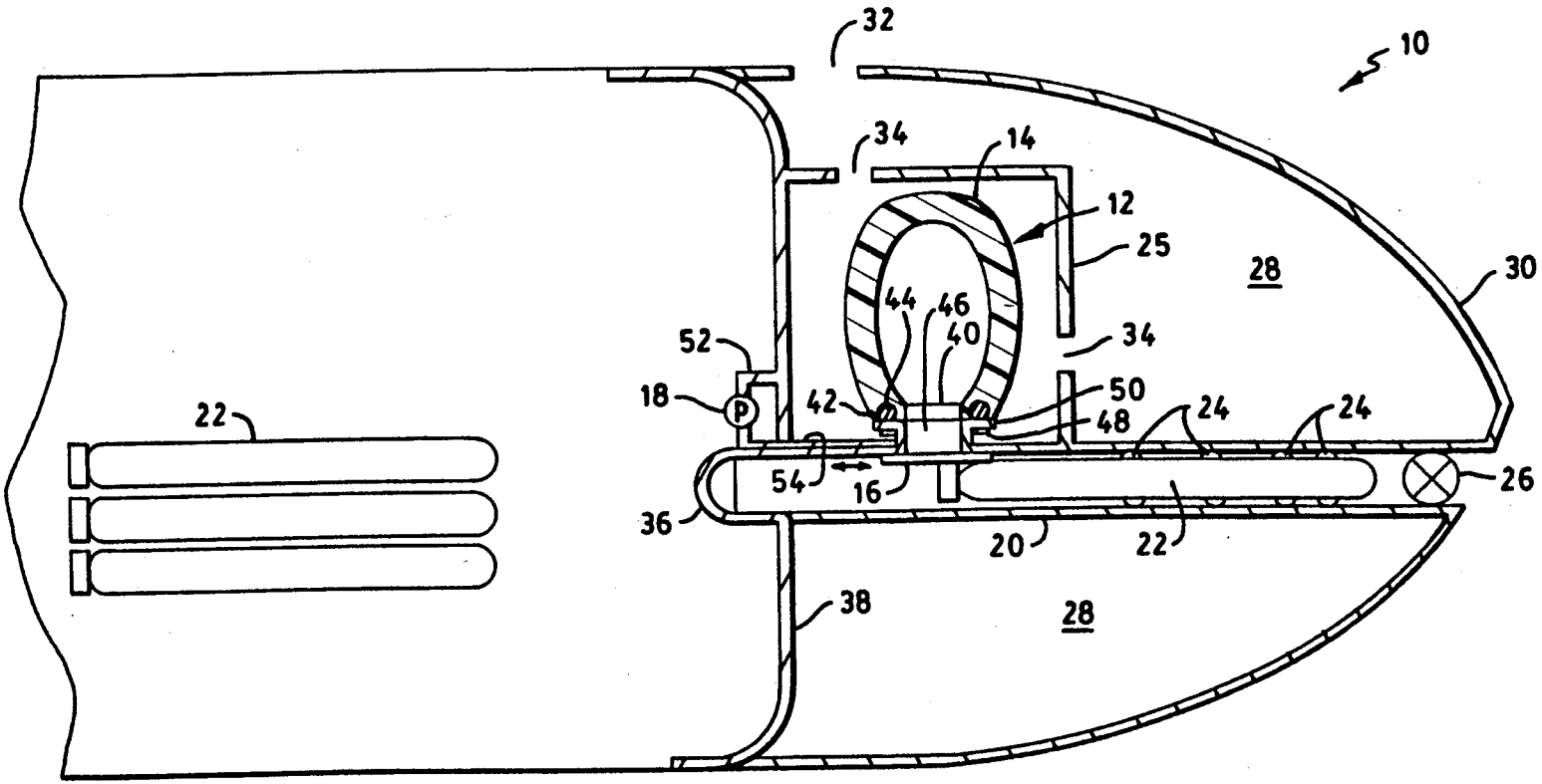
FIG. 7 is a diagrammatic view, partially in section, of a projectile launch system including the accumulator body of FIGS. 2–5, and illustrative of a further embodiment of the invention.

Referring to the drawings, and in particular, FIG. 7, it will be seen that the system described herein has provision for storing potential energy in the form of a distended, fluid filled, elastomeric accumulator, and rapidly and quietly converting the potential energy to kinetic energy by forcibly flowing the stored working fluid through a launch tube housing a projectile. The moving fluid acts to expel the projectile from the launch tube. Such an energy storage and transfer system is particularly well suited for, but not limited to, submarine launch systems.

An illustrative submarine launch system 10 includes an elastomeric accumulator 12 in the form of an elastomeric body 14, a flow control slide valve 16, a pump 18 for providing pressurized liquid to the body 14, and a launch tube 20 for slidably housing a projectile 22 on slidable chocks 24 and directing the stored and released working fluid therethrough. The flow control slide valve 16 is located with respect to the launch tube 20 such that ejected fluid is directed behind the projectile 22.

The system 10 further includes a protective wall structure 25 surrounding the elastomeric body 14, a muzzle valve 26 at the launch end of the tube, and a free-flood compartment 28 defined in part by an outer submarine hull 30. Outside sea water is thus permitted to surround the elastomeric body 14 by means of inlet 32 in the outer submarine hull 30 and inlets 34 in the protective wall structure 25. The protective wall structure 25 provides protection for the elastomeric body 14 from potentially damaging effects of shock and vibration. The water pressure in the free-flood compartment is commensurate with submarine depth.

A breech door 36 is provided at the inboard end of the launch tube 20, inside pressure hull 38.

Figure 1A:
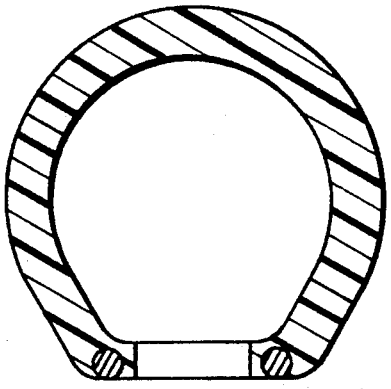
FIG. 1A PRIOR ART
FIGS. 1A–1C illustrate diagrammatically, in section, an elastomeric accumulator body in accordance with prior art.
Figure 1B:
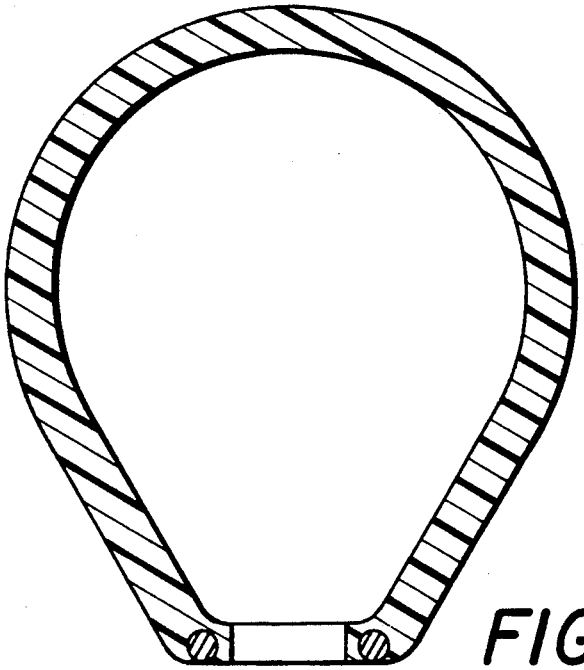
FIG. 1B PRIOR ART
Figure 1C:
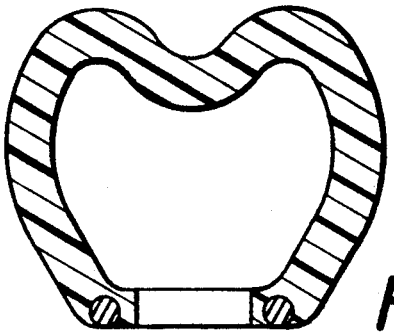
FIG. 1C PRIOR ART

The system, as above described, is known in the art, and is described and shown in U.S. Pat. No. 4,848,210. In FIGS. 1A–1C, there is shown the elastomeric body of the prior art, the body being generally spherical in configuration. When the prior art elastomeric body is opened for the ejection of working fluid therefrom, the egressing fluid moves smoothly and evenly from the body (State A in FIG. 6) to a point at which the body collapses upon itself (FIG. 1C). At this point, the pressure drop at the body opening 40 becomes erratic and even experiences a temporary increase (State B in FIG. 6), accompanied by audible noises which radiate from the submarine through the surrounding fluid medium.

Figure 2:
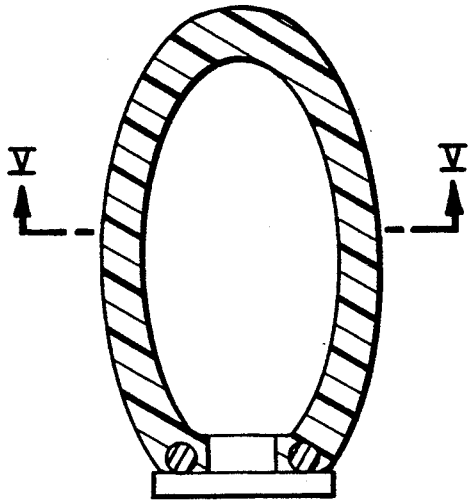
FIGS. 2–4 illustrate diagrammatically, in section, an elastomeric accumulator body illustrative of an embodiment of the invention.
Figure 5:
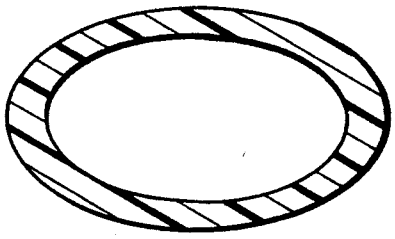
FIG. 5 is a sectional view taken along line V—V of FIG. 2.

In accordance with the present invention, there is provided a new configuration of elastomeric body (FIGS. 2, 3 and 5) having in an elevational aspect thereof (FIG. 2) a frusto-ellipsoidal configuration with a planar base portion 42 having therein the opening 40. Further, in a plane through the body 14 and parallel to the base portion, the body is of an ellipsoidal configuration (FIG. 5).

Figure 3:
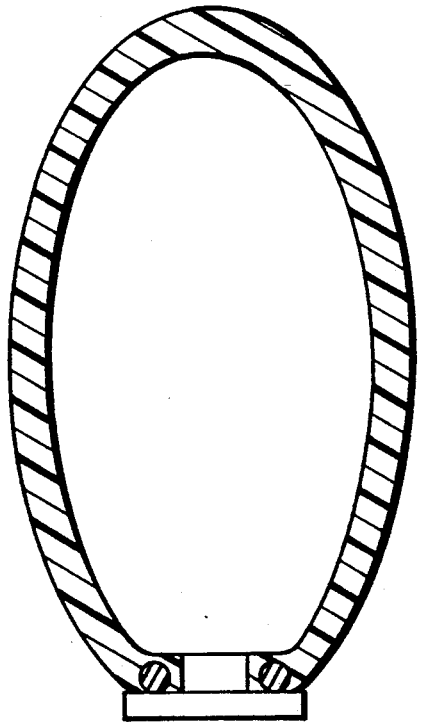
Figure 4:
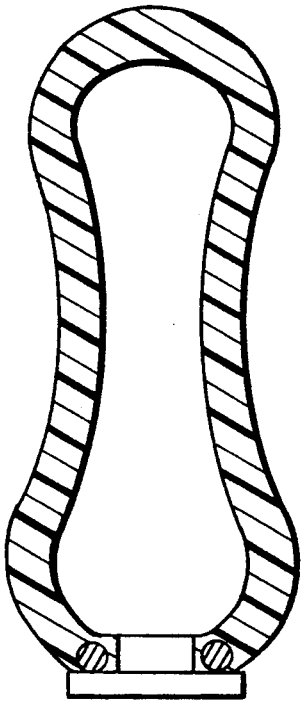

The elastomeric accumulator body 14 of the present invention is adapted to retain its frusto-ellipsoidal configuration in elevation and its ellipsoidal configuration in section when in the expanded condition (FIG. 3). Upon discharge of the working fluid from the body 14, and contraction of the body under sea water pressure, the body is adapted to have side walls thereof converge toward one another in a substantially symmetrical manner (FIG. 4).

Figure 6:
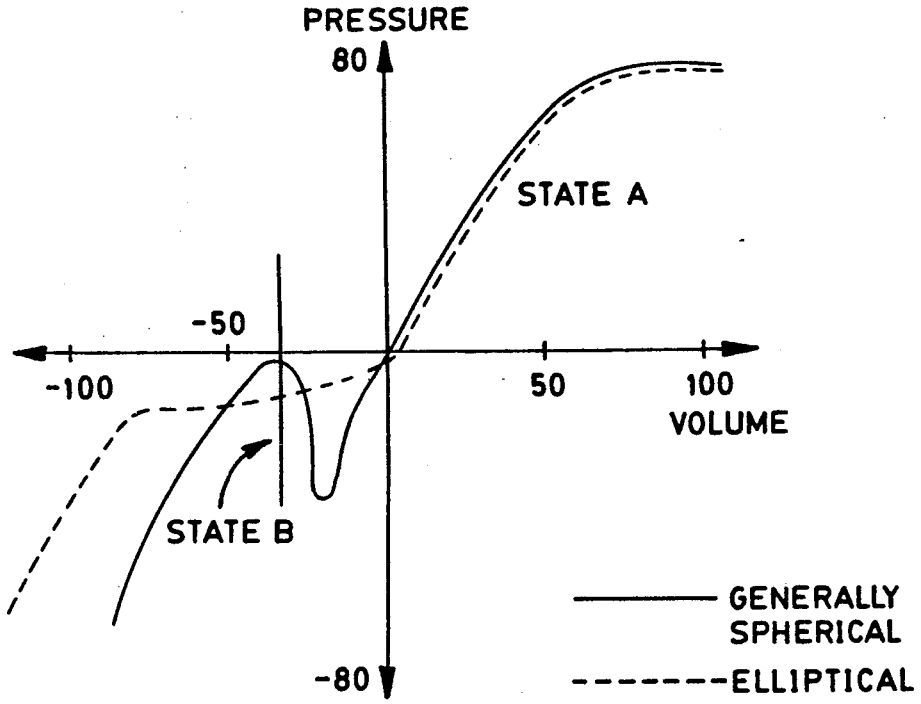
FIG. 6 is a graph illustrative of deflation characteristics of the accumulator bodies of FIGS. 1A–1C and FIGS. 2–5.

It has been found that the ellipsoidal configuration provides for smooth and even flow, as shown in FIG. 6, without the momentary erratic fluctuation and accompanying noise of the prior art accumulator body.

The size, wall thickness, and material properties of the body 14 are selected to provide a desired impulse profile. The material thus chosen for the body 14 has the ability to store sufficient energy to provide the required impulse. Suitable materials include neoprene rubber, urethane, and similar elastomeric materials.

Figure 8:
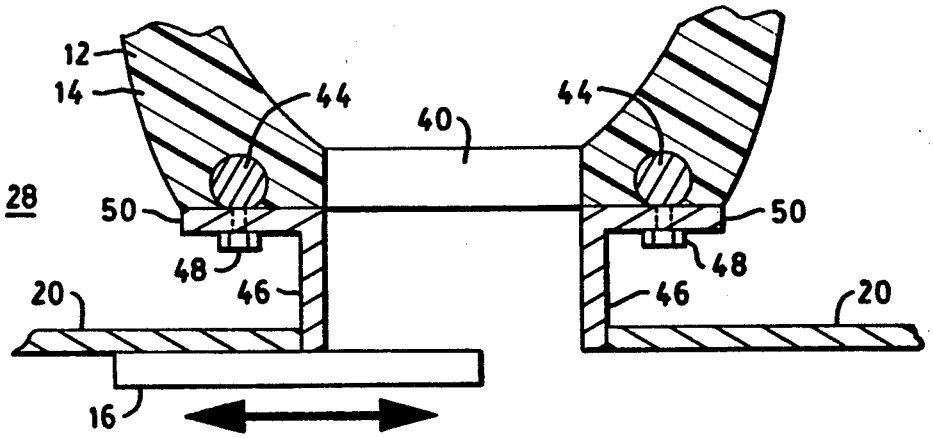
FIG. 8 is an enlarged detailed view of a portion of the system of FIG. 7.

The elastomeric body 14 may be fabricated together with an embedded metal attachment ring 44 (FIG. 8) to form a molded assembly. The body 14 and the ring 44 are secured to a cylindrical collar 46 fixed to the launch tube 20, the axis of the collar 46 being generally normal to the longitudinal axis of the launch tube 20. The flow control valve 16 operates to open communication between the body 14 and the tube 20, via the collar 46, and to close such communication. The body 14 and the ring 44 may be secured to the collar 46 by bolts 48 through a flange portion 50 of the collar 46.

In operation, the elastomeric accumulator 14 is pressurized with working fluid, such as seawater, via the pump 18 located within the pressure hull 38. An inlet pipe 52 provides sea water to the pump 18 from the free-flood compartment 28. An outlet pipe 54 extends from the pump 18, through the pressure hull 38 and to the collar 46. The pump 18 is thereby adapted, with the flow control slide valve 16 closed, to inflate the accumulator body 14 with sea water. The energy used by the pump 18 to pressurize the body 14 is stored by the elongation of the distended elastic walls of the body 14.

When the energy stored in the accumulator body 14 is required for launching the projectile 22, the muzzle valve 26 is opened and the flow control slide valve 16 is opened, permitting the body 14 to contract and discharge the working fluid and the projectile 22.

The disposition of the elastomeric accumulator body 14 in the free-flood compartment 28 ensures that the system remains pressure balanced, automatically compensating for depth changes. The water inlets 32, 34 ensure the presence of sea water around the body 14 to cause rapid contraction of the body. After launch, the pump 18 quietly transfers sea water from the free-flood compartment 28 to the accumulator body 14.

The flow control slide valve 16, in the closed position (FIG. 7) permits filling of the accumulator body 14 and prevents discharge therefrom. In the open position, the valve 16 permits flow of working fluid from the accumulator body, where the fluid is under pressure, to the breech end of the tube 20, forcing the projectile 22 from the tube.

It is to be understood that the present invention is by no means limited to the particular construction herein disclosed and/or shown in the drawings, but also comprises any modifications or equivalents within the scope of the claims.

What is claimed is:

1. An elastomeric impulse energy storage and transfer device comprising an accumulator body of elastomeric material, said body having an opening at a base portion thereof, said body having in elevation a frusto-ellipsoidal configuration, and said body taken along a sectional plane parallel with said base portion having an ellipsoidal configuration, said body being adapted to receive and discharge fluid through said opening, said body being expandable and contractible in response to receiving and discharging, respectively, said fluid, said body being adapted to retain said configurations when in an expanded condition.

2. The elastomeric impulse energy storage and transfer device in accordance with claim 1, wherein said body, upon discharge of said fluid therefrom, is adapted to have side walls thereof converge toward one another in a substantially symmetrical manner.

3. An elastomeric impulse energy storage and transfer system for launch of projectiles into a liquid medium, said system comprising:

a launch tube having a muzzle end and a breech end, said launch tube being adapted to house a projectile and slidably guide said projectile during a launch;

a breech valve attached to said launch tube at said breech end, said breech valve being adapted to provide access to the interior of said launch tube from said breech end for loading said projectile;

a muzzle valve attached to said launch tube at said muzzle end, said muzzle valve being adapted to permit egress of said projectile from said launch tube into said liquid medium;

a cylindrical collar fixed to said launch tube between said muzzle end and said breech end, nearer to said breech end, so as to be disposed behind said projectile, said collar means having a longitudinal axis generally normal to a longitudinal axis of said launch tube, said cylindrical collar being adapted to provide access by a working fluid to said launch tube at a point behind said projectile;

a control valve mounted on said collar for selectively placing the interior of said collar in communication with said interior of said launch tube;

an elastomeric accumulator fixed to said collar at a planar base of said accumulator, said accumulator having in elevation a frusto-ellipsoidal configuration, and said accumulator having an ellipsoidal configuration along a sectional plane parallel with said accumulator base plane;

said accumulator being adapted to store energy by elastic expansion of walls thereof, an exterior surface of said accumulator being exposed to the pressure of said liquid medium; and a pump having a suction side thereof in communication with said liquid medium and a discharge side thereof in communication with said accumulator via said collar, for selectively pumping said liquid into said accumulator to inflate and distend said accumulator;

whereby upon opening of said muzzle valve to flood said launch tube and opening said control valve to place said accumulator in communication with said launch tube via said collar, said accumulator contracts, thereby forcing the liquid medium stored in said accumulator through said collar and out said muzzle end of said launch tube along with said projectile.

4. The system in accordance with claim 3, wherein said accumulator is disposed outside a pressure hull of a submarine and subject to said pressure exerted thereupon by said liquid medium.

5. The system in accordance with claim 3, wherein said accumulator is adapted to retain said frusto-ellipsoidal and said ellipsoidal configurations when in an expanded condition.

6. The system in accordance with claim 5, wherein said accumulator, upon said contraction, is adapted to have side walls thereof converge toward one another in a substantially symmetrical manner.

* * * * *